US012710216B2

(12) United States Patent
Pflomm et al.

(10) Patent No.: US 12,710,216 B2
(45) Date of Patent: Aug. 18, 2026

(54) HEAT EXCHANGER ASSEMBLY FOR A REFRIGERATION DEVICE, AND REFRIGERATION DEVICE COMPRISING SAME

(71) Applicant: BSH Hausgeräte GmbH, Munich (DE)

(72) Inventors: Berthold Pflomm, Ulm (DE); Simon Schechinger, Heidenheim (DE); Elias Brenner, Herbrechtingen (DE); Frank Cifrodelli, Ulm (DE)

(73) Assignee: BSH Hausgeräte GmbH, Munich (DE)

( * ) Notice: Subject to any disclaimer, the term of this patent is extended or adjusted under 35 U.S.C. 154(b) by 127 days.

(21) Appl. No.: 18/708,650

(22) PCT Filed: Dec. 9, 2022

(86) PCT No.: PCT/EP2022/085193
§ 371 (c)(1),
(2) Date: May 9, 2024

(87) PCT Pub. No.: WO2023/105047
PCT Pub. Date: Jun. 15, 2023

(65) Prior Publication Data

US 2025/0003667 A1 Jan. 2, 2025

(30) Foreign Application Priority Data

Dec. 10, 2021 (DE) ..... 10 2021 214 123.4

(51) Int. Cl.
*F25D 17/06* (2006.01)
*F25B 1/00* (2006.01)

(52) U.S. Cl.
CPC ..... *F25D 17/067* (2013.01); *F25B 1/00* (2013.01)

(58) Field of Classification Search
CPC ..... F25D 17/067; F25D 23/10; F25D 2323/0021; F25D 2323/0023; F25D 2323/00282; F25B 1/00
See application file for complete search history.

(56) References Cited

U.S. PATENT DOCUMENTS

| | | | |
|---|---|---|---|
| 2,236,111 | A | 3/1941 | Philipp |
| 7,950,248 | B2 | 5/2011 | Cho |
| 2019/0011172 | A1 | 1/2019 | Hunter et al. |

FOREIGN PATENT DOCUMENTS

| | | | |
|---|---|---|---|
| CH | 713485 | A2 | 9/2018 |
| CN | 107664366 | A | 2/2018 |
| CN | 111609611 | A | 9/2020 |

(Continued)

OTHER PUBLICATIONS

Machine English translation of JPH1047835 to Saotome et al. Translated Dec. 2025 (Year: 1998).*

(Continued)

*Primary Examiner* — Cassey D Bauer
(74) *Attorney, Agent, or Firm* — Laurence A. Greenberg; Werner H. Stemer; Ralph E. Locher

(57) ABSTRACT

A heat exchanger assembly for a refrigeration device, in particular for a domestic refrigeration device, has: a condenser for delivering heat to the environment and a radial fan for conveying an air stream over the condenser. The condenser is arranged at a suction opening of a first air guide channel which is connected to a suction connection of the radial fan.

18 Claims, 7 Drawing Sheets

(56) References Cited

FOREIGN PATENT DOCUMENTS

| | | | | | |
|---|---|---|---|---|---|
| DE | 102016215920 | A1 | | 3/2018 | |
| EP | 1970656 | A2 | | 9/2008 | |
| EP | 2743618 | A1 | * | 6/2014 | ..... F25D 23/003 |
| GB | 974015 | A | | 11/1964 | |
| JP | H0424481 | A | | 1/1992 | |
| JP | H1047835 | | * | 2/1998 | ... F25D 2323/00282 |
| JP | 2007240015 | A | * | 9/2007 | |
| KR | 20090114044 | A | | 11/2009 | |
| KR | 20150056318 | A | * | 5/2015 | ..... F25D 11/02 |
| KR | 20160005987 | A | | 1/2016 | |

OTHER PUBLICATIONS

Machine English language translation of JP2007240015 to Koshiro. Translated Dec. 2025 (Year: 2007).*
English language translation of KR20150056318 to Kim et al. Translated Dec. 2025 (Year: 2015).*

* cited by examiner

HEAT EXCHANGER ASSEMBLY FOR A REFRIGERATION DEVICE, AND REFRIGERATION DEVICE COMPRISING SAME

FIELD AND BACKGROUND OF THE INVENTION

The present invention relates to a refrigeration appliance, in particular a household refrigeration appliance such as a freezer, refrigerator or fridge/freezer, and a heat exchanger assembly for a refrigeration appliance.

Built-in refrigeration appliances are built into a built-in niche delimited by side walls and a rear wall. The installed position of the refrigeration appliance is then typically selected so that a narrow space is left between the rear wall of the refrigeration appliance and the rear wall of the built-in niche to facilitate the circulation of air to assist with the dissipation of the heat transported by the refrigerant circuit to the environment.

It is desirable in principle in household refrigeration appliances for a storage compartment for holding refrigerated items, such as food, beverages, medication or the like, to be as large as possible compared with the space in the appliance that the customer cannot use as storage space. It is therefore advantageous if the components of a refrigerant circuit can be accommodated so that they take up as little space as possible. In the case of built-in refrigeration appliances in particular the space available at the rear is further limited by the rear wall of the built-in niche, impeding efficient heat dissipation.

US 2019/0011172 A1 describes a built-in refrigerator, in which a condenser and a refrigerant compressor of a refrigerant circuit are arranged in a machine compartment. An axial fan is arranged in the machine compartment between the condenser and the compressor, a discharge side of the fan facing the compressor and an intake side of the fan facing the condenser. The fan takes in ambient air through the condenser and guides the air heated at the condenser through a channel to the compressor to cool said compressor.

U.S. Pat. No. 7,950,248 B2 describes a fridge/freezer with a condenser arranged so that it lies below a base of a freezer compartment, an axial fan being arranged in a machine compartment, taking in air by way of the condenser and expelling it into the machine compartment in the direction of a compressor.

EP 2 743 618 A1 discloses a built-in refrigeration appliance, in which a condenser is arranged on a rear wall of the refrigeration appliance. A radial fan is also arranged in a machine compartment of the refrigeration appliance. The radial fan takes in air from the machine compartment and blows it into an air guide channel, which guides the air along the rear wall by way of the condenser.

CH 713 485 A2 describes a refrigeration appliance, in which a condenser is positioned in the machine compartment and air is taken from the machine compartment by way of a deflection channel by means of a radial fan.

SUMMARY OF THE INVENTION

One of the objects of the present invention is to provide better solutions for heat dissipation at a condenser of a refrigeration appliance, for example a built-in refrigeration appliance.

According to the invention this object is achieved by a heat exchanger assembly with the features of the independent heat exchanger claim and by a refrigeration appliance with the features of the independent refrigeration appliance claim.

According to a first aspect of the invention a heat exchanger assembly for a refrigeration appliance, in particular for a household refrigeration appliance such as a freezer, refrigerator or fridge/freezer, comprises a condenser to deliver heat to the environment and a radial fan to convey an air flow by way of the condenser. According to the invention the condenser is arranged at an intake opening of a first air guide channel, which is connected to an intake connection of the radial fan.

According to a second aspect of the invention a refrigeration appliance, in particular a household refrigeration appliance, for example a built-in refrigeration appliance such as a freezer, refrigerator or fridge-freezer is provided. The refrigeration appliance comprises a storage compartment for holding refrigerated items, a machine compartment that is separate from the storage compartment and a refrigerant circuit to dissipate heat from the storage compartment and to deliver heat to the environment, the refrigerant circuit having a heat exchanger assembly according to the first aspect of the invention, arranged in the machine compartment.

One idea underlying the invention is to take in air through an air guide channel by means of a radial fan and to arrange a condenser at an opening of the channel facing away from the radial fan. The radial fan takes in air from the machine compartment, said air being guided by way of the condenser by the arrangement of the condenser within the machine compartment at the opening of the air guide channel. The radial fan can be arranged for example at least partially within the first air guide channel, in particular in the region of an opening of the air guide channel opposite the intake opening. The condenser is located directly in front of the intake opening of the air guide channel, so that the all or at least the majority of the air sucked into the intake opening has to flow through the condenser.

One advantage of the invention is that heat dissipation at the condenser is improved, as at least the majority of the air flow conveyed by the radial fan has to be guided by way of the condenser due to the arrangement of the condenser at the intake opening. In particular parasitic air flows that avoid the condenser are reduced. It is therefore possible to deploy a relatively compact condenser. The radial fan also has the advantage that it can expel at the discharge side counter to a relatively high flow resistance without any significant loss of efficiency. The radial fan can therefore convey a large air mass flow even in built-in installation situations where air has to be expelled through a narrow flow cross section, for example when the refrigeration appliance is installed in a built-in niche.

Advantageous configurations and developments will emerge from the subclaims relating to the independent claims in conjunction with the description.

According to some embodiments provision can be made for the first air guide channel to have a straight, in particular linear center axis, so that the air flow is guided directly from the condenser to the intake connection of the radial fan essentially without any change of flow direction. This further reduces flow loss.

According to some embodiments provision can be made for the heat exchanger assembly to have a second air guide channel, which is connected to a discharge connection of the radial fan and has an extended discharge opening. In particular an end region of the second air guide channel facing away from the radial fan, in which the discharge opening is configured, can project beyond a rear wall of the refrigeration appliance delimiting the storage compartment, the discharge opening optionally being oriented so that air can be expelled from the discharge opening along the rear wall. Provision can then also be made for the radial fan to discharge the air taken in into a second air guide channel, by way of which the air is expelled through an extended, slot-type opening on a rear face of the refrigeration appliance. The extended shape of the opening has the advantage that it creates a relatively large flow cross section while taking up relatively little space. Efficient discharge is also possible along the rear wall of the refrigeration appliance or the second flow channel can guide the discharged air in a direction parallel to the rear wall, further reducing flow resistance. In particular it allows the rear wall of the refrigeration appliance to be positioned very close to a rear wall of a built-in niche, advantageously increasing the space available for the refrigeration compartment.

According to some embodiments provision can be made for the discharge opening to extend over at least 30 percent, in particular over at least 50 percent, also optionally over at least 80 percent of a width of the rear wall of the refrigeration appliance. This advantageously allows a large part of the available width of the rear wall to be used for flow guiding.

According to some embodiments provision can be made for the heat exchanger assembly to have a sealing lip to rest against a rear wall of a built-in niche for the refrigeration appliance, the sealing lip being arranged on an outer surface of the second air guide channel in the region of the discharge opening and extending over an entire length of the discharge opening. A sealing lip can thus be positioned on the discharge channel, being located for example between the intake opening of the first air guide channel and the discharge opening of the second air guide channel relative to a vertical direction extending parallel to the rear wall. When the refrigeration appliance is positioned in the built-in niche, the sealing lip rests against the rear wall of the built-in niche. The sealing lip, the rear wall of the built-in niche and the rear wall of the refrigeration appliance therefore delimit a discharge space, into which the discharge opening of the second air guide channel opens. This also prevents a flow short circuit of the radial fan.

According to some embodiments provision can be made for a flow cross section of the first air guide channel to taper from the intake opening to the intake connection of the radial fan. The first air guide channel can be configured for example as substantially funnel-shaped, tapering successively. This totally or largely avoids sudden cross section changes in the flow channel, with the result that the air can be transported through the first air guide channel with little flow loss.

According to some embodiments provision can be made for the first air guide channel to be in contact with the condenser in the region of the intake opening. For example the first air guide channel can enclose an outer periphery of the condenser with a peripheral wall that defines the intake opening. In other words the condenser can project for example into the intake opening and be in contact with an inner surface of the first air guide channel. Alternatively an end face of the first air guide channel, which surrounds the intake opening, can be in contact with an end face of the condenser. This further increases the proportion of the air flow conveyed by the fan, which flows through the condenser.

According to some embodiments provision can be made for the condenser to be configured as a microchannel heat exchanger. Microchannel heat exchangers have the advantage of being very compact.

According to some embodiments provision can be made for the condenser to have a plurality of parallel plates, multiple channels for the passage of refrigerant being configured therein, and a plurality of ribs, arranged between the plates and in thermally conducting contact with the plates, the ribs projecting beyond the plates on a side facing away from the first air guide channel. Together with the plates the ribs delimit flow channels that are closed in a peripheral direction and through which the air taken in by the radial fan flows. If the ribs also project from the plates on the side of the plates facing away from the first air guide channel, flow guide structures that are partially open in the peripheral direction result in the protruding subregions. This effectively enlarges the openings of the flow channels through which air is taken in. This advantageously reduces flow loss further. The enlargement of the openings also reduces flow loss that comes about due to dust deposits in the region of the openings.

According to some embodiments provision can be made for the radial fan to be arranged opposite the condenser, the condenser extending perpendicular to a rotation axis of the radial fan. This allows the first air guide channel to be configured as a substantially straight channel. This further reduces flow loss on the intake side of the radial fan and facilitates a space-saving arrangement of radial fan and condenser in the machine compartment.

According to some embodiments provision can be made for the machine compartment to have a base, a top wall opposite the base and side walls extending between the base and the top wall, the base, top wall and side walls delimiting a rear opening and the second air guide channel, in particular the discharge opening, being arranged in the region of the rear opening. The top wall and base can extend in particular perpendicular to the rear wall of the refrigeration appliance. The machine compartment can advantageously be open, in other words only delimited by the base, side walls and top, at a rear of the refrigeration appliance defined by the rear wall. The discharge opening of the second air guide channel is arranged in the region of the rear. For example the second air guide channel can extend through the rear opening of the machine compartment to expel air along the rear wall of the refrigeration appliance.

According to some embodiments provision can be made for the condenser to extend parallel to the base of the machine compartment and for the radial fan to be arranged between the condenser and the top wall. In this installed position the radial fan facilitates a space-saving, low-loss diversion of air parallel to the top wall, e.g. into the second air guide channel.

According to some embodiments provision can be made for the condenser to extend perpendicular to the base and for the radial fan to be arranged between the condenser and the rear opening. In this installed position the radial fan expels the air substantially parallel to the rear wall at its discharge connection, so that the optionally provided second air guide channel can be configured substantially straight. This generally further reduces discharge side flow loss.

According to some embodiments provision can be made for the condenser to be arranged opposite an opening in a condensed water tray. The intake of air through the condenser brings about an air flow toward the condenser around said condenser. This also generates an air flow, which encourages the evaporation of condensed water, in the region of the opening in the condensed water tray, which collects condensed water from the refrigeration compartment. The arrangement of the condensed water tray opposite the condenser, e.g. between the base of the machine compartment and the condenser, is also very compact.

The features and advantages disclosed in relation to one aspect of the invention are also disclosed for the other aspects.

BRIEF DESCRIPTION OF THE FIGURES

The same reference characters designate identical components or those of identical function in the figures, unless otherwise stated.

DETAILED DESCRIPTION OF THE INVENTION

Figure 1:
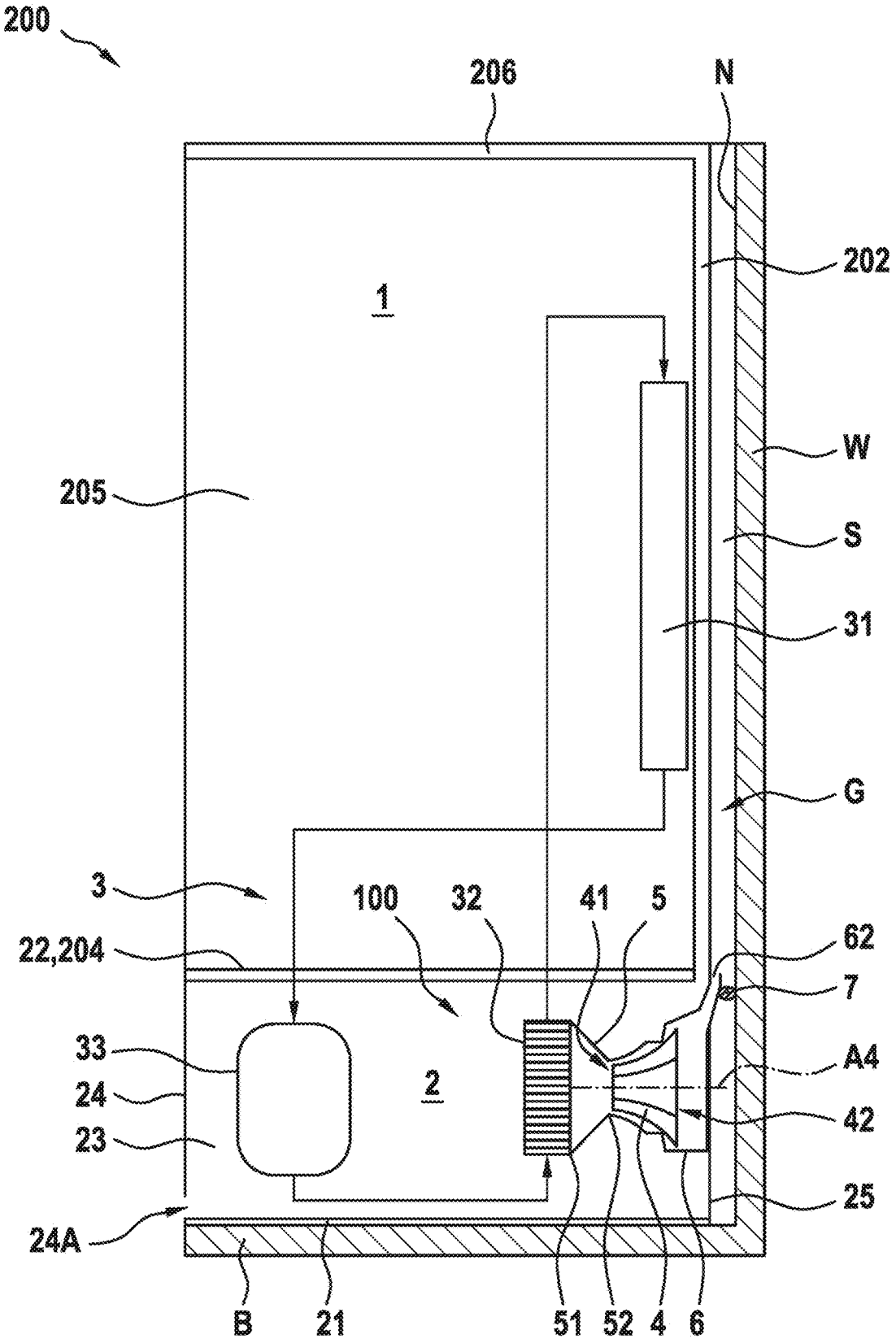
FIG. 1 shows a simplified schematic sectional view of a refrigeration appliance according to one exemplary embodiment of the invention.

FIG. 1 shows a refrigeration appliance 200 by way of example in the form of a built-in refrigerator. The description which follows refers by way of example to said refrigeration appliance 200, although the invention is not limited hereto. Generally the refrigeration appliance 200 can be a household refrigeration appliance, for example a refrigerator, fridge-freezer or freezer. As shown schematically in FIG. 1, the refrigeration appliance 200 has a storage compartment 1, a machine compartment 2, a refrigerant circuit 3 and a heat exchanger assembly 100.

The storage compartment 1 is configured to hold refrigerated items such as food, beverages, medication or the like and is delimited by a base 204, a top wall 206 arranged opposite the base 204, opposing side walls 205, which extend between the base 204 and the top wall 206, and a rear wall 202, which extends between the base 204 and the top wall 206 and between the side walls 205.

The machine compartment 2 is defined by a compartment that is separate from the storage compartment 1 and can, as shown by way of example in FIG. 1, adjoin the base 204 of the storage compartment 1. For example the machine compartment 2 can be delimited by a base 21 and a top wall 22 opposite this, as well as by opposing side walls 23, which extend between the base 21 and the top wall 22. The top wall 22 of the machine compartment 2 can be formed for example by the base 204 of the storage compartment 1, as shown by way of example in FIG. 1. A front cover 24 can optionally be provided, further delimiting the machine compartment 2, the front cover 24 extending between the base 21 and the top wall 22, as well as between the side walls 23. The front cover 24 can in particular have an inlet opening 24A, as shown schematically in FIG. 1. The inlet opening 24A allows an exchange of air between the machine compartment 2 and the environment. The front cover 24 is arranged at an end of the machine compartment 2 opposite the rear wall 202. The machine compartment 2 can be open in the region of the rear wall 202, the side walls 23, top wall 22 and base 21 together defining a rear opening 25.

As shown schematically in FIG. 1, the refrigeration appliance 200 can be arranged in a niche N defined by a rear wall W, side walls S and a base B. The rear wall 202 of the refrigeration appliance 200 here faces the rear wall W of the built-in niche (recess) N, a gap G being left between the rear walls 202, W. The base 21 of the machine compartment 2 stands on the base B of the built-in niche N.

The refrigerant circuit 3 comprises an evaporator 31, a condenser 32 and a compressor 33 as well as a throttle point (not shown). The compressor 33 is configured to circulate refrigerant, an intake connection of the compressor 33 being connected to an output of the evaporator 31 and a discharge connection of the compressor 33 being connected to an input of the condenser 32. An output of the condenser 32 is connected to an input of the evaporator 31, the throttle point being located between the output of the condenser 32 and an input of the evaporator 31. The evaporator 31 is coupled thermally to the storage compartment 1 and liquid refrigerant evaporates in the evaporator 31 as it absorbs heat from the storage compartment 1. The compressor 33 takes in the evaporated refrigerant and conveys it at higher pressure to the condenser 32, where the refrigerant condenses while delivering heat to the environment. The refrigerant expands at the throttle point. The refrigerant circuit 3 is therefore configured to dissipate heat from the storage compartment 1 and to deliver heat to the environment.

The condenser 32 is part of a heat exchanger assembly 100 arranged in the machine compartment 2 and also comprising a radial fan 4, a first air guide channel 5 and an optional second air guide channel 6. The heat exchanger assembly 100 can also optionally have a sealing lip 7. FIG. 1 shows a schematic diagram of the basic structure of the heat exchanger assembly 100. Different heat exchanger assemblies 100 are shown in detail in FIGS. 2 to 6.

As shown schematically in FIG. 1, the radial fan 4 can be rotated about a rotation axis A4, for example by means of a motor (not shown), to convey an air flow. The radial fan 4 has an intake side or intake connection 41 to take in air along the rotation axis A4 and a discharge connection or discharge side 42 to expel air in a direction perpendicular to the rotation axis A4. As shown schematically in FIG. 1, the radial fan 4 can be arranged in particular opposite the condenser 32, the rotation axis A4 extending perpendicular to the condenser 32 or the intake connection 41 facing the condenser 32.

Figure 4:
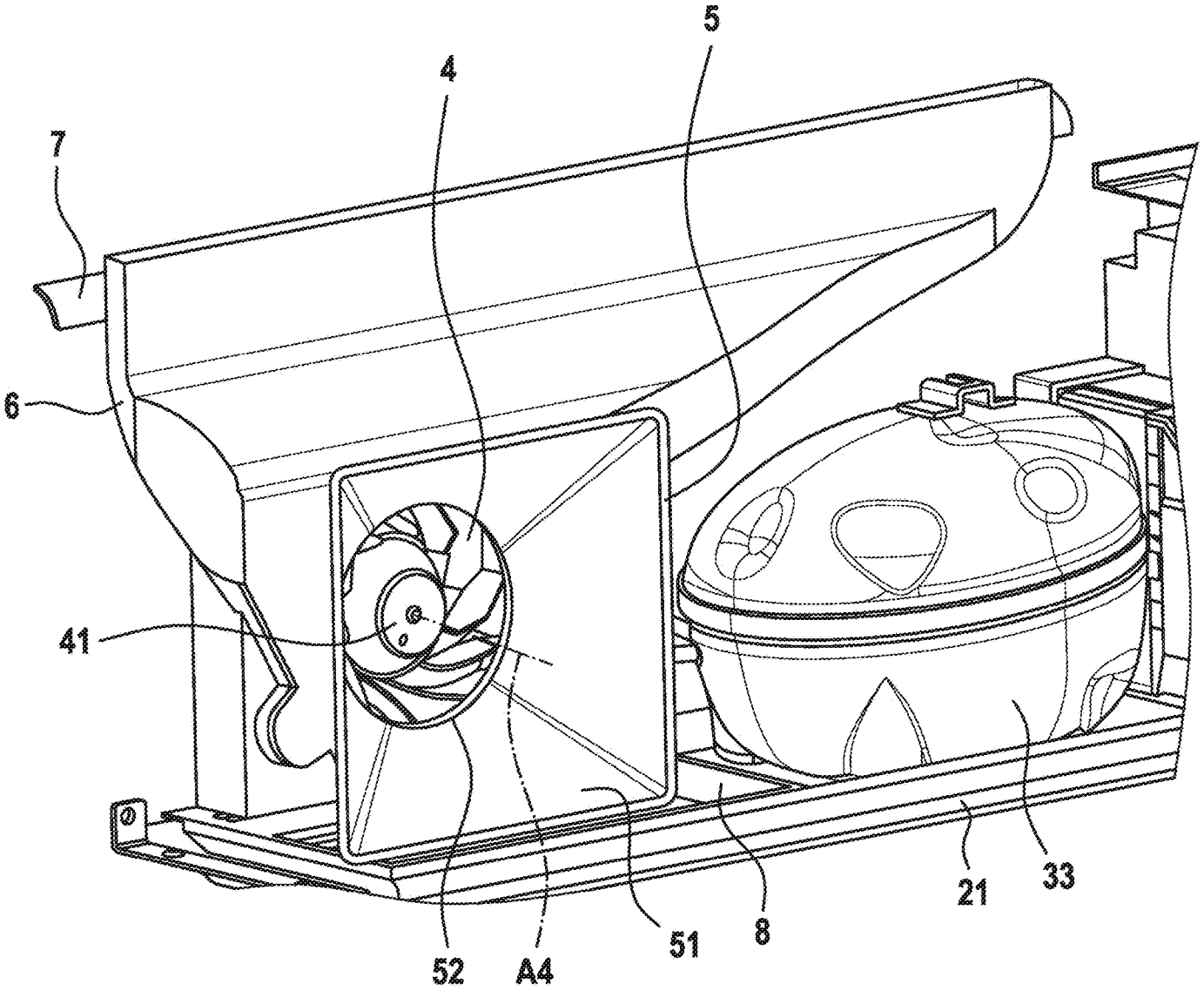
FIG. 4 shows the view from FIG. 3, omitting a condenser of the heat exchanger assembly.

The first air guide channel 5 extends between an intake opening 51 and an outlet opening 52, in particular so that one of the air channels 5 has a straight center axis. As shown schematically in FIG. 1, the condenser 32 is arranged at the intake opening 51 of the first air guide channel 5. The outlet opening 52 is connected to the intake connection 41 of the fan 4. Rotation of the radial fan 5 therefore allows air to be taken in from the machine compartment 2, the arrangement of the condenser 32 at the intake opening 52 meaning that at least a large proportion of the air taken in has to be guided by way of the condenser 32. If the first air guide channel 5 has a straight center axis, e.g. as shown in FIG. 4, the air flow is guided directly from the condenser 32 to the intake connection of the fan 4 essentially without a change of flow direction. The air taken in from the machine compartment 2 by the radial fan 4 can then be delivered for example through the inlet opening 24A of the front cover 24 or another opening connecting the machine compartment 2 to the environment. The enforced guiding of the air by way of the condenser 32 improves the transfer of heat at the condenser 32, thereby allowing the condenser 32 to be more compact.

The optional second air guide channel 6 is connected to the discharge connection 42 of the radial fan 4 and has a discharge opening 62, through which the air expelled by the fan 4 can be conveyed out of the machine compartment 2. The discharge opening 62 is arranged in an end section 6B of the second air guide channel 6 facing away from the radial fan 4. As shown by way of example in FIG. 1, the discharge opening 62 can be arranged in the region of the rear wall 202 of the refrigeration appliance 200. In particular the discharge opening 62 can be oriented so that air can be expelled along the rear wall 202. As shown by way of example in FIG. 1, the end section 6B of the second air guide channel 6, in which the discharge opening 62 is configured, can be arranged in the region of the top wall 22 of the machine compartment 2. As also shown in FIG. 1, the end section 6B can optionally project beyond the rear wall 202 of the refrigeration appliance 200. In the refrigeration appliance 200 shown by way of example in FIG. 1 the air is therefore expelled into the gap G between the rear wall 202 of the refrigeration appliance 200 and the rear wall W of the niche N. As the radial fan 4 has a relatively high compressive rigidity, the gap G can be relatively narrow. This facilitates an increase in the useful volume of the storage compartment 1.

Figure 2:
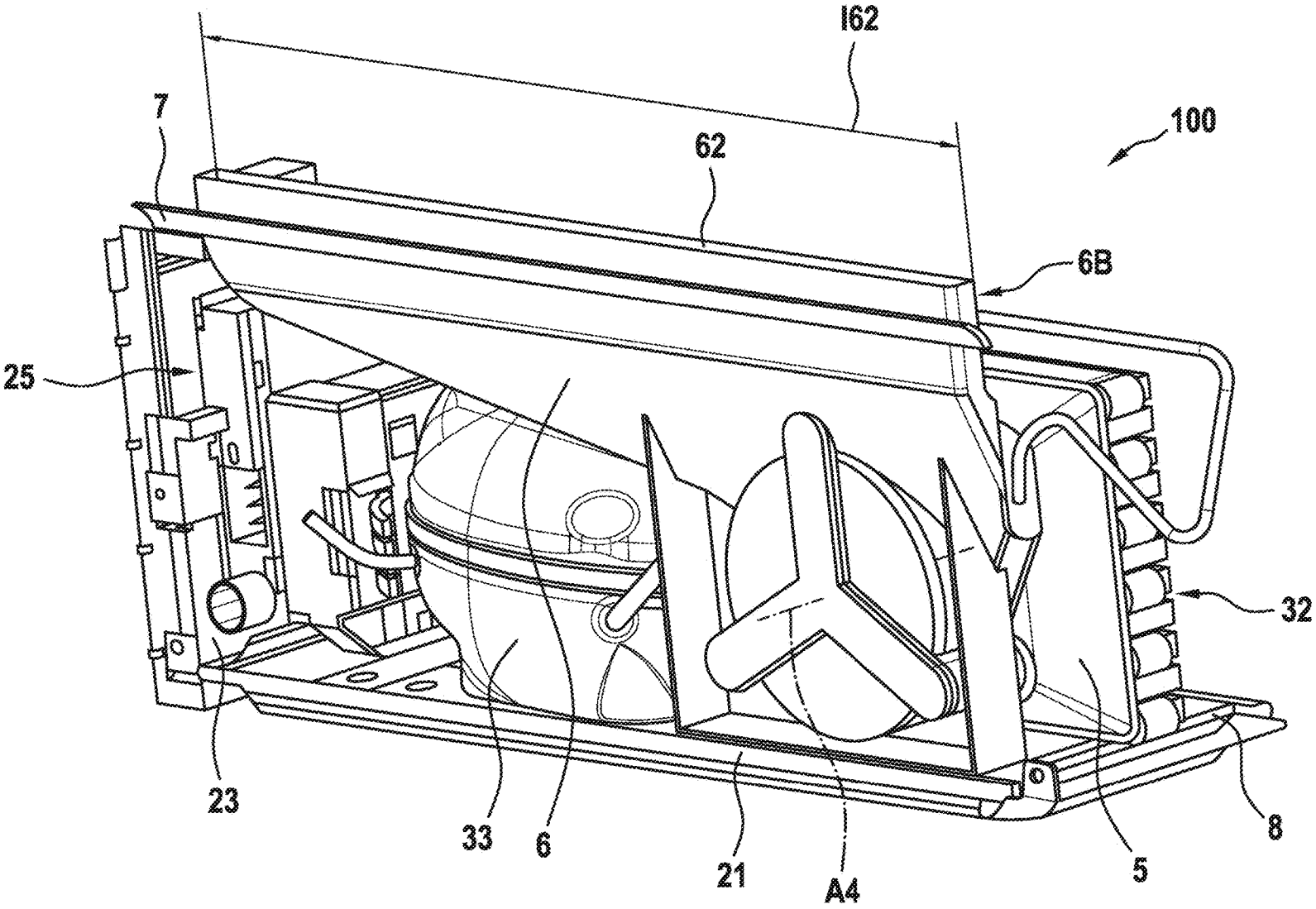
FIG. 2 shows a perspective view of a heat exchanger assembly according to one exemplary embodiment of the invention.
Figure 3:
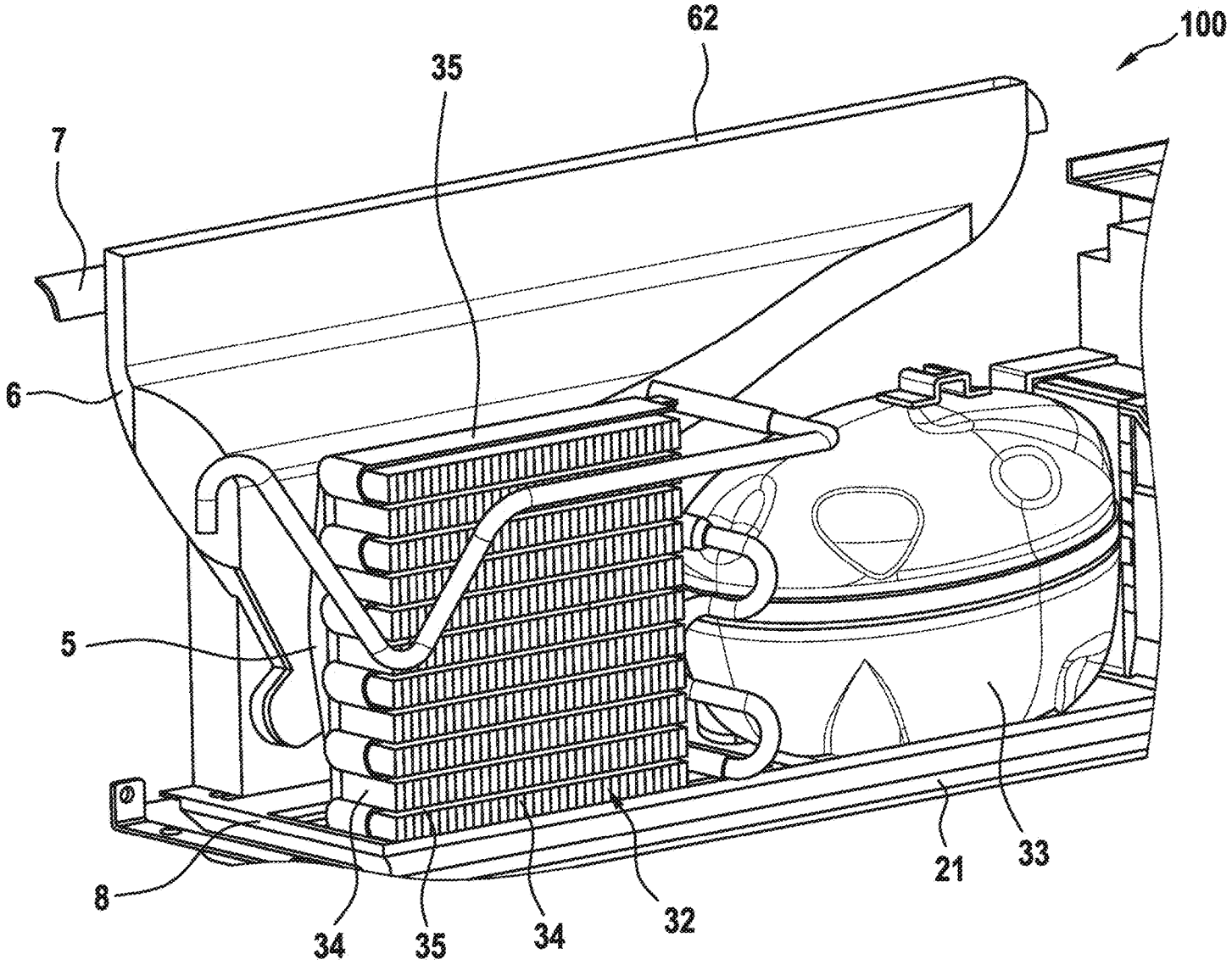
FIG. 3 shows a further perspective view of the heat exchanger assembly from FIG. 2.

FIG. 2 shows a perspective view of a heat exchanger assembly 100, which is arranged in the machine compartment 2 of a refrigeration appliance 200, looking toward the rear opening 25 of the machine compartment 2. FIG. 3 shows a further perspective view of the heat exchanger assembly from FIG. 2 looking in the opposite direction. FIG. 4 shows the view from FIG. 3, without the condenser 32.

Figure 7:
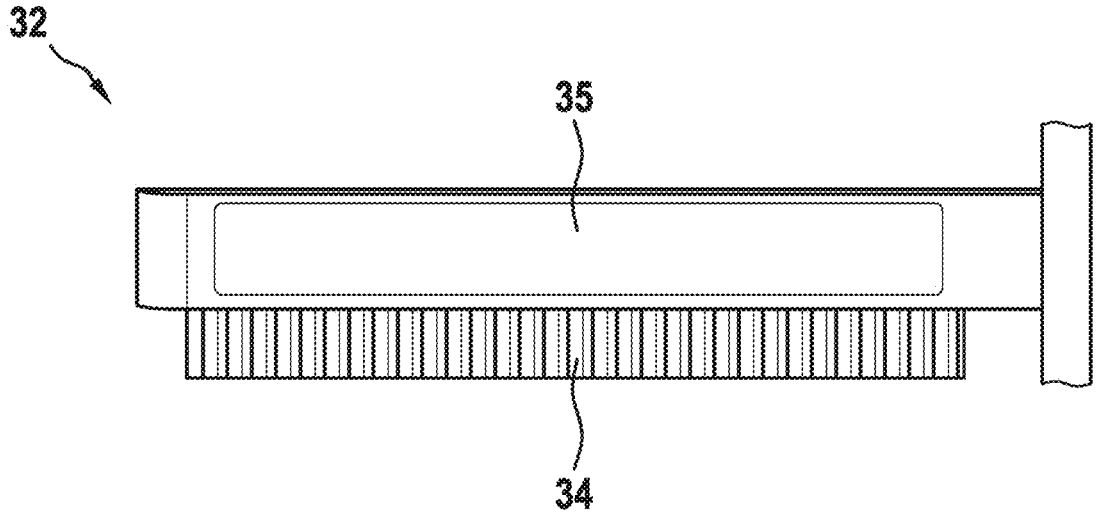
FIG. 7 shows a plan view of a condenser of a heat exchanger assembly according to one exemplary embodiment of the invention.

As can be seen in particular in FIG. 3, the condenser 32 can be configured as a microchannel heat exchanger. The condenser 32 here has a plurality of parallel plates 35 and a plurality of ribs 34. Multiple channels for the passage of refrigerant are configured in the plates 35. The ribs 34 are arranged between the plates 35 and are in thermally conducting contact with the plates. As shown in FIG. 3 and made clear in a plan view of the condenser 32 in FIG. 7, provision can optionally be made for the ribs 34 to project beyond the plates 35 on a first side of the condenser 31.

As also shown in FIG. 3, the condenser 32 can be oriented relative to the first air guide channel 5 so that the first side with the projecting ribs 34 faces away from the first air guide channel 5. Generally the condenser 32 can be arranged directly in front of or in the intake opening 51 of the first air guide channel 5, so that the condenser 32 completely covers or fills the intake opening 51. In particular the first air guide channel 5 can be in contact with the condenser 32 in the region of the intake opening 51. As also shown in FIG. 3, provision can be made for the condenser 32 to extend perpendicular to the base 21 of the machine compartment 2. This is also shown in FIG. 1. In this instance, as shown in FIG. 1 and from looking at both FIGS. 3 and 4, the radial fan 4 can be arranged between the condenser 32 and the rear opening 25 of the machine compartment 2.

As shown by way of example in FIG. 4, the first air guide channel 5 can taper from the intake opening 51 to the outlet opening 52. For example the intake opening 52 can define a rectangular periphery and the outlet opening 52 can be configured as circular with a smaller diameter, as shown in FIG. 4.

As shown in particular in FIG. 2, the discharge opening 62 of the second air guide channel 6 can be configured in an extended manner. For example provision can be made for the discharge opening 62 to extend over at least 30 percent, in particular at least 50 percent, also optionally over at least 80 percent of a width of the rear wall 202 of the refrigeration appliance 200. A length 162 of the discharge opening 62 can thus be at least 50 percent, in particular at least 80 percent of a width of the rear wall 202.

As shown by way of example in FIGS. 1 and 2, the optional sealing lip 7 can be arranged on an outer surface 6*a* of the second air guide channel 6 in the region of the discharge opening 62. For example the sealing lip 7 can be positioned in the end section 6B of the air guide channel 6. The sealing lip 7 extends over an entire length 162 of the discharge opening 62 and can optionally project to the side of the end section 6B of the second air guide channel 6, as shown by way of example in FIG. 2. As shown schematically in FIG. 1, the sealing lip 7 is provided to rest against the rear wall W of a built-in niche N, so that the gap G is sealed in the direction of the rear opening 25 of the machine compartment 2, to prevent a flow short circuit of the radial fan 4.

Figure 5:
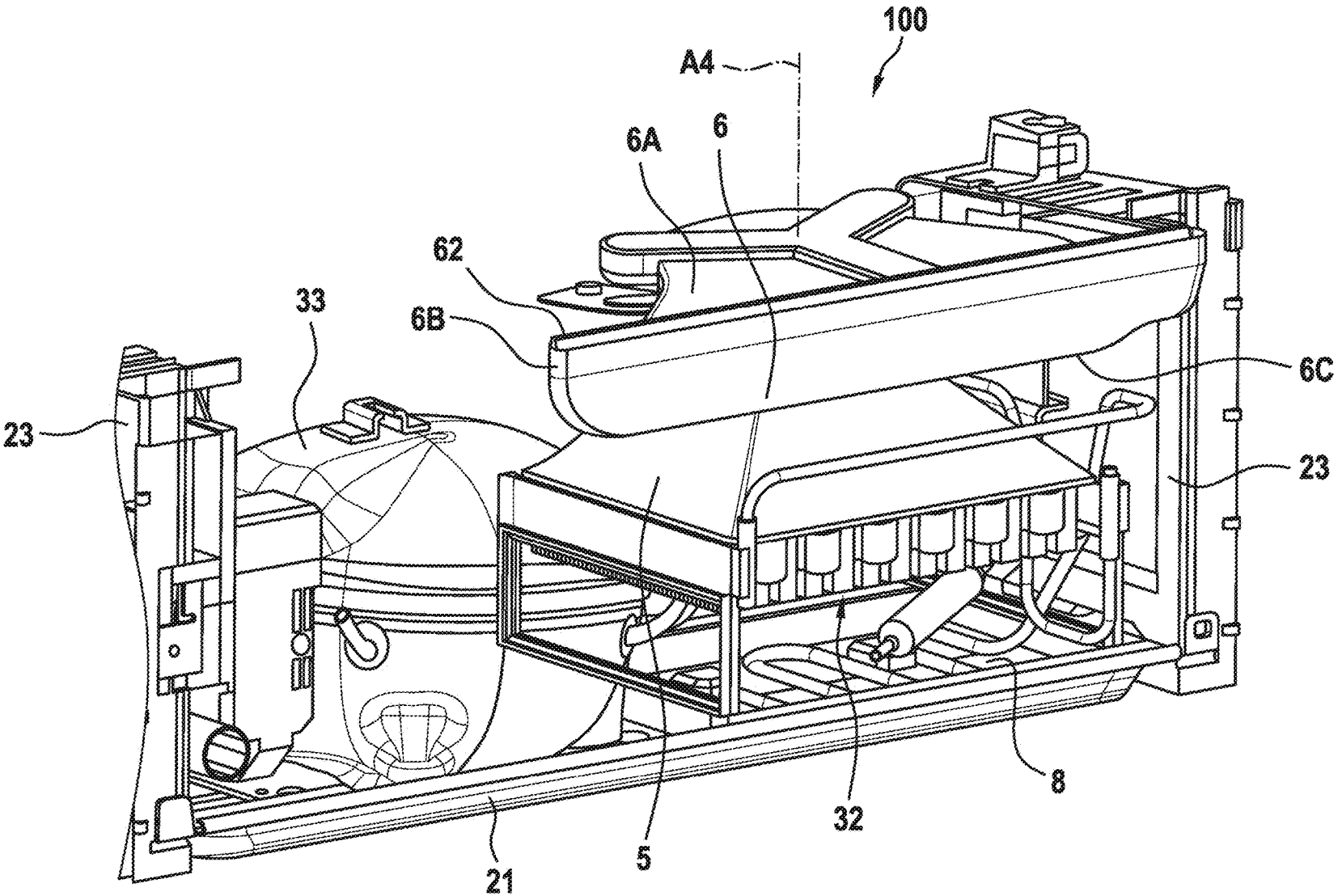
FIG. 5 shows a perspective view of a heat exchanger assembly according to a further exemplary embodiment of the invention.
Figure 6:
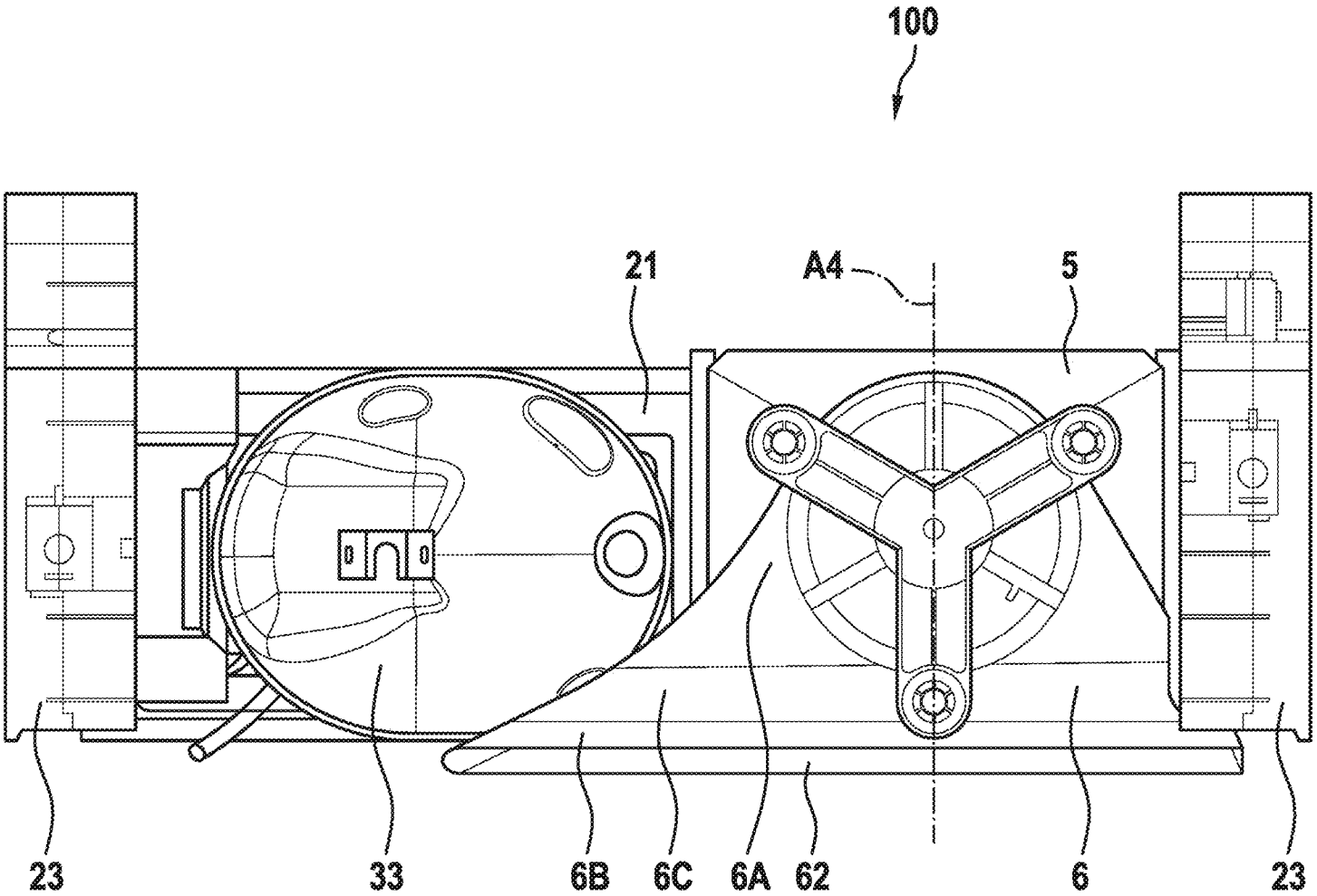
FIG. 6 shows a plan view of the heat exchanger assembly from FIG. 5.

FIG. 5 shows a perspective view of a further heat exchanger assembly 100, which is arranged in the machine compartment 2 of a refrigeration appliance 200, looking toward the rear opening 25 of the machine compartment 2. FIG. 6 shows a plan view of the heat exchanger assembly from FIG. 5 from the side of the top wall 22. The heat exchanger assembly 100 shown in FIGS. 5 and 6 differs from the heat exchanger assemblies 100 only in the orientation of the radial fan 4, first flow channel 5 and condenser 32 relative to the base 21 of the machine compartment 2. As shown in FIGS. 5 and 6, provision can be made for the condenser 32 to extend parallel to the base 21 of the machine compartment 2 and for the radial fan 4 to be arranged between the condenser 32 and the top wall 22 of the machine compartment 2. The intake opening 51 of the first air guide channel 5 is thus oriented facing the base 21 of the machine compartment 2. As also shown in FIG. 5, the second air guide channel 6 can have a section 6A running substantially parallel to the base 21 or to the condenser 32, to which the end section 6B is connected by a curved transition section 6C.

Irrespective of the orientation of the condenser 32 it can be arranged opposite an opening of a condensed water tray 8, as shown by way of example in FIGS. 2 to 6.

Although the present invention has been described above in an exemplary manner based on exemplary embodiments, it is not restricted thereto but can be modified in many different ways. Combinations of the exemplary embodiments set out above in particular are conceivable.

REFERENCE CHARACTERS

1 Storage compartment
2 Machine compartment
3 Refrigerant circuit
4 Radial fan
5 First air guide channel
6 Second air guide channel
6A Section of second air guide channel
6B End section of second air guide channel
6C Curved section of second air guide channel

7 Sealing lip
8 Condensed water tray
21 Base of machine compartment
22 Top wall of machine compartment
23 Side walls of machine compartment
24 Front cover of machine compartment
24A Inlet opening of front cover
25 Rear opening of machine compartment
31 Evaporator
32 Condenser
33 Compressor
34 Ribs
35 Plates
41 Intake connection of radial fan
42 Discharge connection of radial fan
51 Intake opening
52 Outlet opening
62 Discharge opening
100 Heat exchanger assembly
200 Refrigeration appliance
202 Rear wall of refrigeration appliance
204 Base of storage compartment
205 Side walls of storage compartment
206 Top of storage compartment
B Base of built-in niche
G Gap
S Side wall of built-in niche
W Rear wall of built-in niche

The invention claimed is:

1. A heat exchanger assembly for a refrigeration appliance, the heat exchanger assembly comprising:
- a condenser for delivering heat to an environment;
- a radial fan to convey an air flow by way of said condenser, said radial fan having an intake connection and a discharge connection;
- a first air guide channel having an intake opening formed within said first air guide channel and connected to said intake connection of said radial fan, said condenser disposed at said intake opening of said first air guide channel such that the air flow is guided generally without a change of flow direction from said condenser into said intake opening; and
- a second air guide channel connected to said discharge connection of said radial fan and having an extended discharge opening expelling the air flow along a rear wall of the refrigeration appliance.

2. The heat exchanger assembly according to claim 1, further comprising a sealing lip to rest against a rear wall defining a built-in niche for the refrigeration appliance, said sealing lip disposed on an outer surface of said second air guide channel in a region of said extended discharge opening and extending over an entire length of said extended discharge opening.

3. The heat exchanger assembly according to claim 1, wherein said first air guide channel has a flow cross section that tapers from said intake opening to said intake connection of said radial fan.

4. The heat exchanger assembly according to claim 1, wherein said first air guide channel is in contact with said condenser in a region of said intake opening.

5. The heat exchanger assembly according to claim 1, wherein said condenser is configured as a microchannel heat exchanger.

6. The heat exchanger assembly according to claim 5, wherein said condenser has a plurality of parallel plates, multiple channels for a passage of refrigerant disposed in said parallel plates, and a plurality of ribs, disposed between said parallel plates and in thermally conducting contact with said parallel plates, said ribs projecting beyond said parallel plates on a side facing away from said first air guide channel.

7. The heat exchanger assembly according to claim 1, wherein said radial fan is disposed opposite said condenser, and wherein said condenser extends perpendicular to a rotation axis of said radial fan.

8. The heat exchanger assembly according to claim 1, wherein the refrigeration appliance is a household refrigeration appliance.

9. A refrigeration appliance, comprising:
- a storage compartment for holding refrigerated items;
- a rear wall;
- a machine compartment being separate from said storage compartment; and
- a refrigerant circuit to dissipate heat from said storage compartment and to deliver the heat to an environment, said refrigerant circuit having a heat exchanger assembly disposed in said machine compartment, said heat exchanger assembly containing:
  - a condenser for delivering the heat to the environment;
  - a radial fan to convey an air flow by way of said condenser, said radial fan having an intake connection and a discharge connection;
  - a first air guide channel having an intake opening formed therein and connected to said intake connection of said radial fan, said condenser disposed at said intake opening of said first air guide channel such that the air flow is guided generally without a change of flow direction from said condenser into said intake opening; and
  - a second air guide channel connected to said discharge connection of said radial fan and having an extended discharge opening expelling the air flow along said rear wall.

10. The refrigeration appliance according to claim 9, wherein said second air guide channel has an end region facing away from said radial fan, in which said extended discharge opening is configured, projects beyond said rear wall of the refrigeration appliance delimiting said storage compartment and said extended discharge opening is oriented so that air can be expelled from said extended discharge opening along said rear wall.

11. The refrigeration appliance according to claim 10, wherein said extended discharge opening extends over 30 percent of a width of said rear wall of the refrigeration appliance.

12. The refrigeration appliance according to claim 10, wherein said machine compartment has a base, a top wall opposite said base and side walls extending between said base and said top wall, said base, said top wall and said side walls defining a rear opening and said second air guide channel is disposed in a region of said rear opening.

13. The refrigeration appliance according to claim 12, wherein said condenser extends parallel to said base and said radial fan is disposed between said condenser and said top wall.

14. The refrigeration appliance according to claim 12, wherein said condenser extends perpendicular to said base and said radial fan is disposed between said condenser and said rear opening.

15. The refrigeration appliance according to claim 9, further comprising a condensed water tray having an opening formed therein, said condenser is disposed opposite said opening of said condensed water tray.

16. The refrigeration appliance according to claim 10, wherein said extended discharge opening extends over at least 50 percent of a width of said rear wall of the refrigeration appliance.

17. The refrigeration appliance according to claim 10, wherein said extended discharge opening extends over at least 80 percent of a width of said rear wall of the refrigeration appliance.

18. The refrigeration appliance according to claim 12, wherein said extended discharge opening of said second air guide channel is disposed in a region of said rear opening.

* * * * *